United States Patent [19]

Issakainen

[11] Patent Number: 4,643,619

[45] Date of Patent: Feb. 17, 1987

[54] APPARATUS FOR FEEDING CEMENT MATERIAL INTO A DRILL HOLE FOR CEMENT BOLTING OF A ROCK

[75] Inventor: Onni Issakainen, Tampere, Finland

[73] Assignee: Oy Tampella AB, Tampere, Finland

[21] Appl. No.: 617,335

[22] Filed: Jun. 5, 1984

[30] Foreign Application Priority Data

Jun. 13, 1983 [FI] Finland ..... 832124

[51] Int. Cl.[4] ..... E21D 20/02

[52] U.S. Cl. ..... 405/303; 405/240; 405/260

[58] Field of Search ..... 405/237, 240, 260, 261, 405/303

[56] References Cited

U.S. PATENT DOCUMENTS

| | | | |
|---|---|---|---|
| 3,270,511 | 9/1966 | Colle | 405/240 X |
| 3,344,611 | 10/1967 | Philo | 405/240 |
| 3,434,294 | 3/1969 | Hall | 405/238 |
| 4,045,966 | 9/1977 | Rusche | 405/240 |
| 4,116,368 | 9/1978 | Smith | 405/260 |
| 4,440,526 | 4/1984 | Koppers et al. | 405/260 |

*Primary Examiner*—Dennis L. Taylor

*Attorney, Agent, or Firm*—Ladas & Parry

[57] ABSTRACT

A method of feeding cement into a drill hole for cement bolting of a rock, according to which a feeder pipe (2) is pushed into the hole essentially to the bottom of the hole portion to be filled with cement, cement is fed into the hole beginning from the bottom of the hole portion, and the pipe is displaced outwards in the hole when the cement fills the hole. The feeding of cement is stopped and the pipe is removed when the amount of cement is sufficient to fill the gap between the wall of the hole and the rock bolt to be pushed into the hole. The displacement of the pipe is controlled by means of the filling pressure (TP) caused by the cement fed between the pipe tip and the bottom of the hole portion to ensure that the hole is reliably filled despite possible cracks and crushed zones.

An apparatus for carrying out the method comprises a feeder pipe provided with a tip of such a size that the penetration of cement through the gap between the hole and the tip requires a pressure which is higher than a predetermined set value of the cement feed pressure and causes an outwards pushing force on the tip.

2 Claims, 18 Drawing Figures

Figures 1A, 1B, 1C, 1D, 1E, 1F, 1G:
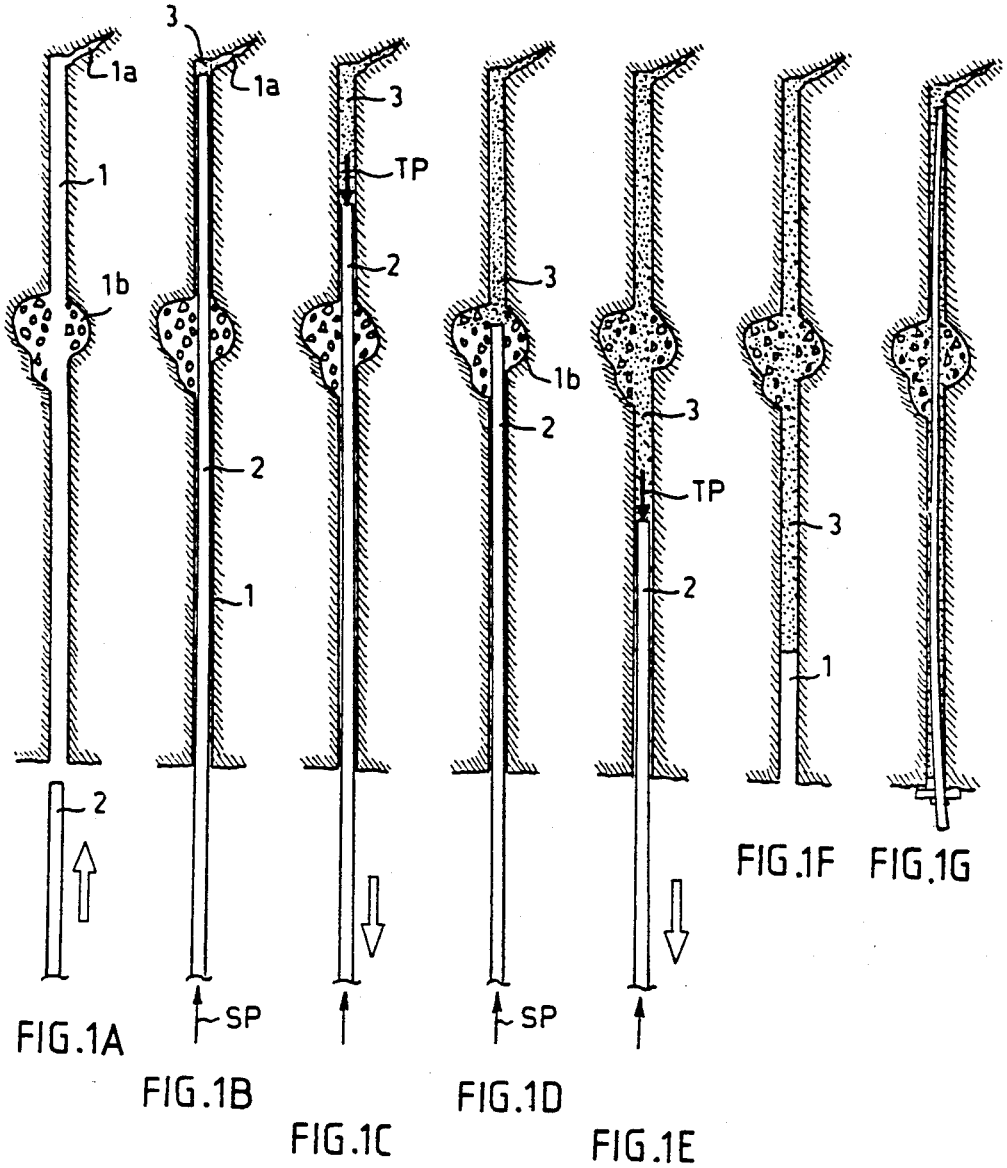

1a
1
1b
2
3
1a
2
1
SP
3
TP
2
3
1b
2
SP
3
TP
2
3
1

APPARATUS FOR FEEDING CEMENT MATERIAL INTO A DRILL HOLE FOR CEMENT BOLTING OF A ROCK

This invention relates to a method of feeding cement material into a drill hole for cement bolting of a rock, according to which method a feeder pipe is pushed into the hole essentially to the bottom of the hole portion to be filled with cement material through the feeder pipe, cement material is fed into the hole beginning from the bottom of said hole portion, the feeder pipe is displaced outwards in the hole when cement material fills the hole, the feeding of cement material is stopped when the amount of cement material is sufficient to fill the gap between the wall of the hole and the rock bolt to be pushed into the hole over a desired length, and the feeder pipe is removed from the hole.

In rock bolting, bolts are fastened by means of cement material, such as concrete, in holes drilled in the rock in order tostrengthen the rock in mines and in rock chambers.

From the Swedish patent application No. 7901616-3 a rock bolting equipment is previously known by means of which the drilling of a hole, the feeding of cement material and the pushing of a rock bolt into the hole can be carried out mechanically with a uniform apparatus. The apparatus is provided with a feeder pipe for cement material, which is attached to a slide moving along a supporting beam by means of which the feeder pipe can be pushed into the hole drilled in the rock and removed from the hole.

The feeding of cement material into the drill hole is performed in this known apparatus by pushing the feeder pipe to the bottom of the hole and by feeding cement material into the hole simultaneously as the feeder pipe is drawn outwards in the hole. In order to draw out the feeder pipe, the operation of the transport motor moving the slide of the feeder pipe is positively synchronized with the operation of the motor of the feed pump for the cement material.

The drawback with such a manner of feeding cement material is, however, that it is not possible to make sure in a reliable way that the drill hole really is filled with the desired amount of cement material. There can be crushed zones and cracks in the rock, into which cement material can penetrate when it is fed into the hole. When the feeder pipe for cement material is in such a case drawn outwards synchronously with the feeding of cement material, the result is that the hole is incompletely filled, because the cement material penetrates into the crushed zones and the cracks and there does not remain a sufficient amount of cement material in the hole from the viewpoint of a secure fastening of the rock bolt.

The object of this invention is to provide a method which avoids the above drawback and causes a reliable filling of a drill hole with cement material even when there are crushed zones and cracks in the rock. This object is achieved with a method according to the invention, which is characterized in that the feeder pipe is displaced outwards by means of the filling pressure caused in the hole by the cement material fed between the end of the feeder pipe and the bottom of the hole portion to be filled with cement material through the feeder pipe.

The invention is based on the idea that the return movement or outward displacement of the feeder pipe in the drill hole is caused by the pressure increase created by the cement material filling the hole when the hole portion to be filled has been filled with cement material. In this connection, filling pressure means the pressure with which the cement material in the hole tries to resist feeding of more cement material into the hole and to push the feeder pipe outwards in the hole after the cement material has filled the space between the feeder pipe tip and the bottom of the hole portion to be filled with cement material. The hole portion to be filled with cement material can vary in different bolting cases. If the bolt is fastened in the hole only by means of cement material, the hole portion to be filled begins at the bottom of the hole. If a capsule or capsules containing an accelerating agent or some other substance have been fed to the bottom of the hole, the hole portion to be filled begins from that end of the capsule or capsules pushed to the bottom of the hole, which end is positioned towards the mouth of the drill hole. It is also possible that a strong fastening is desired only for the inner end of the bolt when the outer end is left free. Then the portion to be filled corresponds only to the desired fastening length of the bolt. If the hole is uncracked, the cement material subjects the feeder pipe to an outwardly pushing pressure immediately when the hole is filled from the bottom of the hole portion to be filled to the feeder pipe tip. This pressure is used according to the invention for moving the feeder pipe outwards in the hole at the same speed as the hole is being filled with cement material, either positively by drawing the feeder pipe mechanically outwards in the hole or automatically by letting the filling pressure push the feeder pipe outwards when the hole is being filled. If, on the contrary, there are crushed zones and cracks in the rock, into which cement material penetrates instead of filling the hole, no such filling pressure is produced in the drill hole by the cement material and therefore the feeder pipe does not move outwards in the hole. Not until the crushed zone or cracks are filled with cement material, a sufficient pressure is produced in the hole for moving the feeder pipe outwards, and the operation continues again in the normal manner.

The apparatus according to the invention is based on the idea that the gap between the feeder pipe and the wall of the drill hole is sufficiently narrow, so that the penetration of cement material between the feeder pipe and the rock is not possible without producing a pressure action on the feeder pipe. The size of this gap depends to a great extent on the cement material used and its viscosity. Therefore, the diameter of the feeder pipe tip, upon which the filling pressure of the cement material mainly acts, can be even considerably smaller than the diameter of the drill hole.

The sensing of the filling pressure of the cement material and the use of the filling pressure for returning the feeder pipe can be technically realized in many different ways, as appears from the following description.

Figure 3:
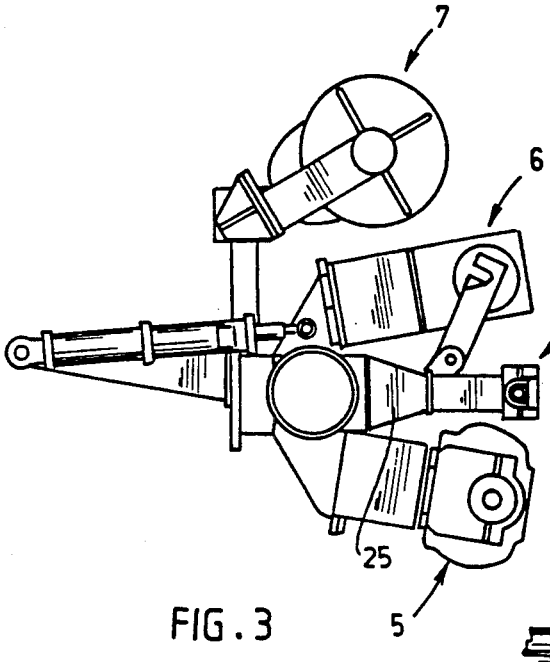
Figure 2:
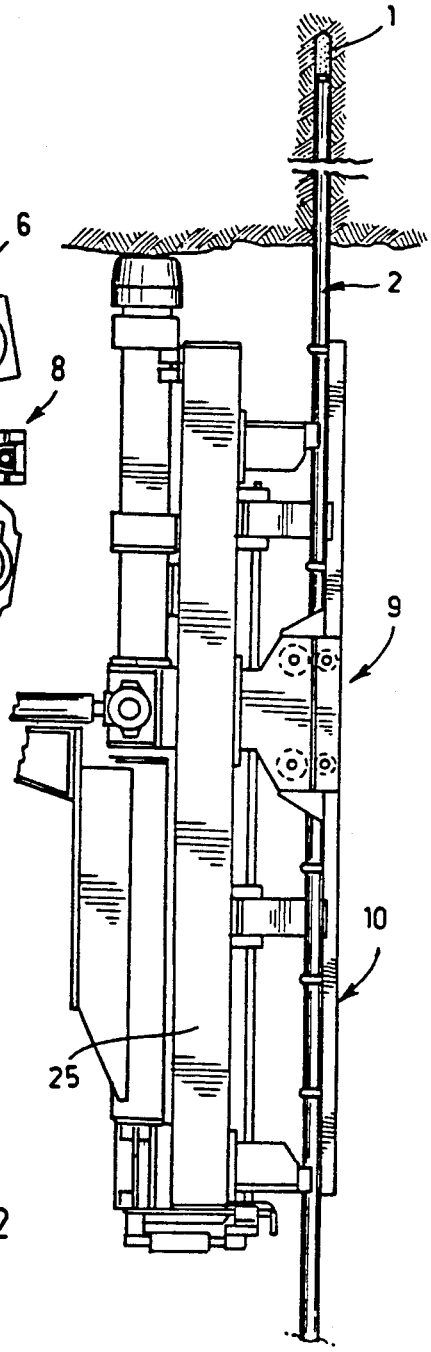
Figure 4:
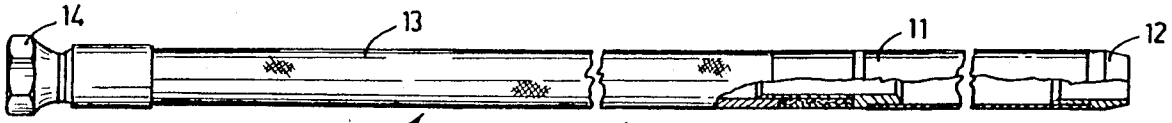
Figure 5:
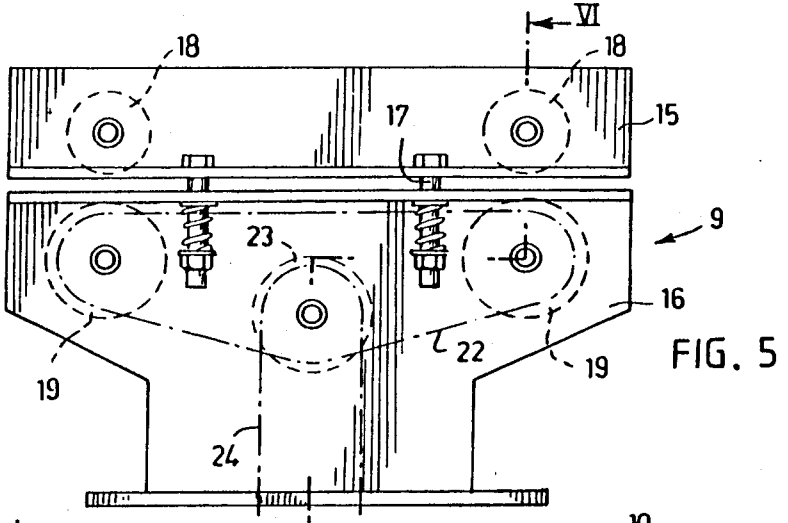
Figure 7:
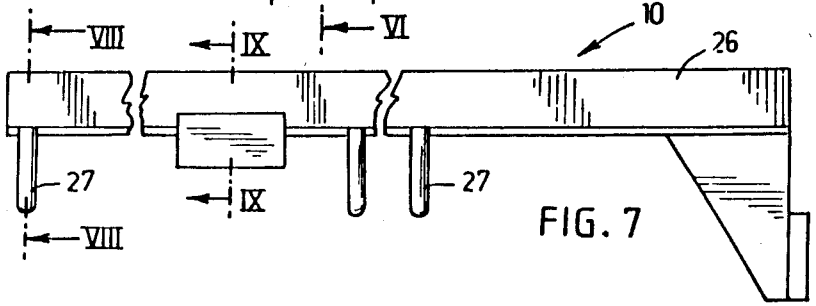
Figure 6:
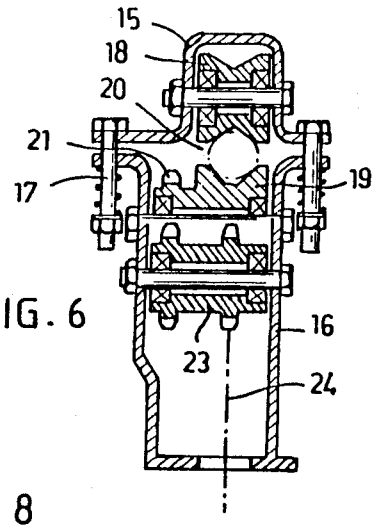
Figure 9:
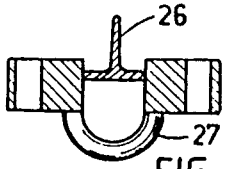
Figure 8:
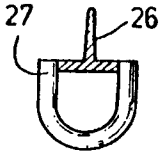
Figure 10:
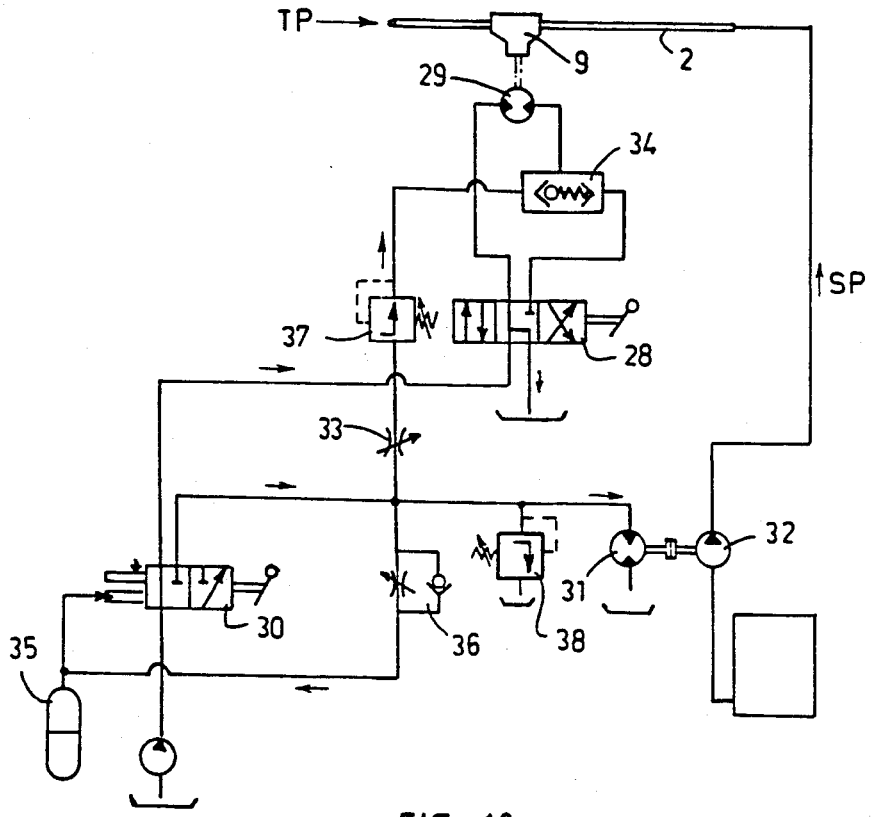
Figure 11:
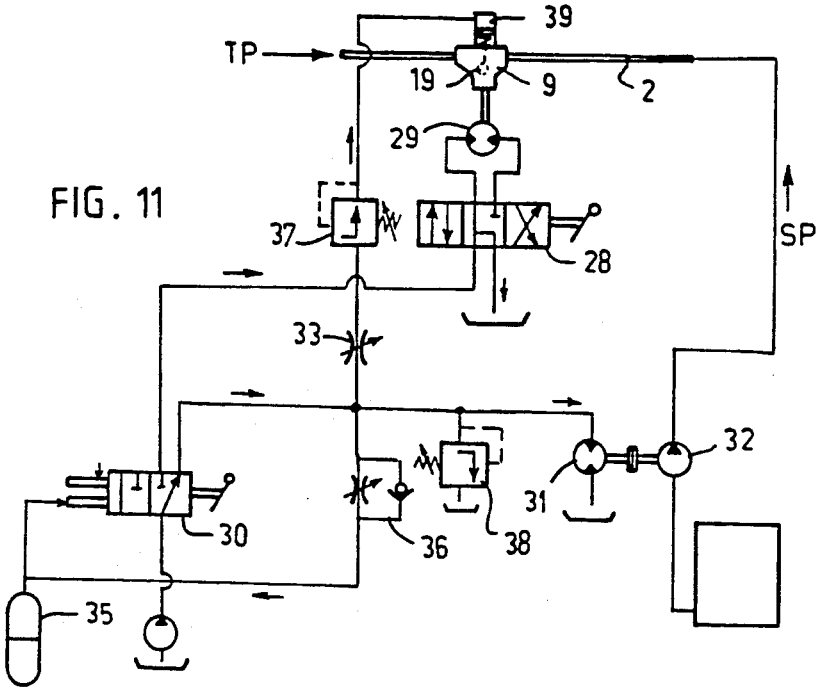
Figure 12:
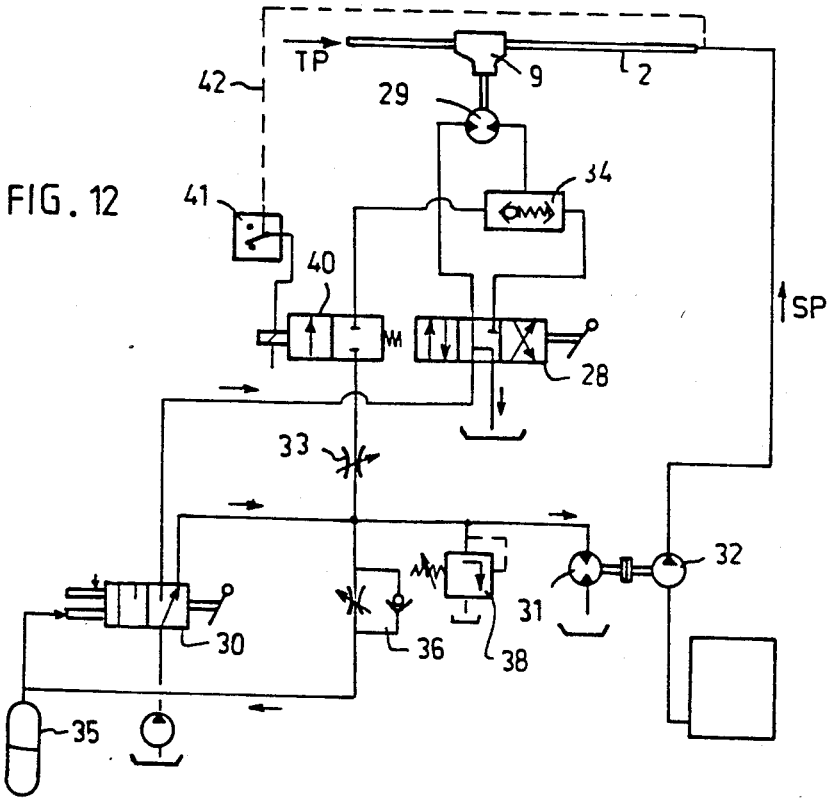

In the following the invention is described in more detail with reference to the enclosed drawings, wherein, FIGS. 1A to 1G are schematical views of different operating steps of feeding cement material and bolting carried out by means of the method according to the invention, FIGS. 2 and 3 are side and end views respectively of a rock bolting apparatus provided with a feeding device for cement material according to the invention, FIG. 4 is a side view of a preferable embodiment of the feeder pipe, FIG. 5 is a side view of a preferable embodiment of the actuator, FIG. 6 is a sectional view along line VI—VI in FIG. 4, FIG. 7 is a side view of a preferable embodiment of the supporting device, FIGS. 8 and 9 are sectional views along line VIII—VIII and IX—IX respectively in FIG. 7, FIG. 10 is a first control circuit for the feeding device for cement material, FIG. 11 is a second control circuit for the feeding device, and FIG. 12 is a third control circuit for the feeding device.

FIGS. 1A to 1G of the drawings illustrate the different operating steps of the method according to the invention.

According to FIG. 1A a feeder pipe 2 is pushed into a hole 1 drilled in the rock. The feeder pipe is pushed to the bottom of the hole portion to be filled with cement material and cement material 3 is pumped through the pipe into the drill hole, FIG. 1B. The material penetrates into cracks 1*a* in the rock. When the cracks and the space between the bottom of the hole and the feeder pipe tip have been filled with cement material and the feeder pipe still feeds cement material into the hole, the cement material tries to penetrate into the gap between the feeder pipe and the rock. Because this gap is very narrow, it is difficult for the cement material to penetrate into the gap. Therefore the cement material produces in the hole a filling pressure TP which acts on the feeder pipe tip, FIG. 1C. Due to this pressure the feeder pipe moves outwards in the hole in a manner described more in detail in the following, simultaneously as the feeder pipe feeds cement material into the hole. When the feeder pipe tip reaches new cracks or a crushed part 1*b*, the cement material penetrates into the crushed zone, whereby the pressure of the cement material in the hole decreases and the moving outwards of the feeder pipe stops, FIG. 1D. When the crushed zone has been filled with cement material and the cement material again causes a filling pressure TP on the feeder pipe tip, the feeder pipe again begins to move outwards in the hole with the same speed as the hole is being filled with cement material, FIG. 1E. The feeding of cement material is stopped when there is a sufficient amount of cement material in the hole to fill the gap between the bolt and the rock to the desired length, possibly the entire length of the bolt, after which the feeder pipe is removed from the hole, FIG. 1F. A rock bolt 4 is pushed so deep into the hole that the base plate of the bolt touches the rock surface, whereby the cement material fills the gap between the bolt and the rock and, after hardening, secures the bolt in the rock, FIG. 1G. In order to maintain the bolt in the hole before the cement material has hardened, the bolt is provided with a suitable locking element.

The main parts of the rock bolting apparatus shown in FIGS. 2 and 3 are a drilling device 5, a bolt feeding device 6, a bolt cassette 7 and a feeding device 8 for cement material. Parts 5 to 7 are known per se and therefore their construction and operation are not described in more detail in this context.

The feeding device 8 comprises a feeder pipe 2, an actuator 9 and a supporting device 10.

The feeder pipe 2 shown in FIG. 4 comprises a rigid pipe 11. A nozzle 12 is attached to one end of the pipe and a flexible hose to the other end. The free end of the hose is provided with a connector 14 by which the hose is connected to a pump 32, FIG. 10, for pumping cement material to the feeder pipe.

The diameter of the feeder pipe is dimensioned with respect to the diameter of the drill hole so that the penetration of cement material into the gap between the feeder pipe and the rock requires a higher pressure than the feeding pressure of the cement material. Hereby the continuous feeding of cement material into the drill hole subjects the end of the pipe to a force, which is proportional to the feeding pressure and pushes the pipe outwards in the hole, when the space between the bottom of the hole portion to be filled and the feeder pipe tip is wholly filled with cement material.

It is also possible to use a flexible hose instead of the rigid pipe 11 at the front end of the feeder pipe. The end of the hose can be provided with a separate feeding nozzle which can be replaced when it is worn out. When using a flexible hose, the feeding nozzle guides the hose when it is pushed into the hole.

The actuator 9 shown in FIGS. 5 and 6 comprises two frame parts 15, 16 which are fastened flexibly to each other by bolts 17. Two rolls 18 resp. 19 having parallel shafts spaced from each other are pivotally mounted in each frame part. The rolls are positioned in pairs opposite to each other and are provided with a peripheral groove so that each roll pair forms between the rolls a drive gap 20 for the pipe 11. The drive gap is dimensioned so that the rolls press against the pipe from opposite sides.

The rolls 19 mounted in the lower frame part are provided with sprocket wheels 21 supporting a chain 22. This chain extends over a double sprocket wheel 23 mounted in the lower frame part, which supports a drive chain 24 rotated by a motor 29 shown in FIG. 10 consequently, the motor rotates the rolls 19 in the lower frame part by means of the chains.

The actuator 9 is supported by the frame 25 of the bolting device.

The supporting device 10 shown in FIGS. 7 to 9 comprises a support beam 26 attached to a frame 25 of the bolting device in parallel with the frame. U-shaped guide links 27 are fastened at a distance from each other to that side of the support beam which is positioned towards the frame 25. The guide links are of such a size that the feeder pipe can slide through the guide links. The support beam is supported against the actuator 9 so that the guide links are coaxial with the drive gap 20 of the actuator. The distance between the guide links is chosen so that, when using a flexible hose as a feeder pipe, the hose can stand the feeding force without buckling. When using a rigid pipe as a feeder pipe, one guide link is sufficient at least on the distance controlled by the supporting device, when the link is provided at the front end of the supporting beam.

Due to the above described construction the feeder pipe 2 is movable with respect to the supporting beam along the guide links when the rolls 19 of the actuator are rotated by means of the rotating motor. The feeder pipe can thus be mechanically pushed into the drilled hole for feeding cement material and drawn outwards in the hole during the feeding of cement material.

FIG. 10 shows a control circuit for obtaining an automatical operation of the feeding device.

When a lever of a control valve 28 for the actuator 9 is pushed forwards, pressure oil flows into a hydraulic motor 29 of the actuator which starts to rotate the rolls 19 by means of the chains, so that the rolls push the feeder pipe 2 into the hole 1. When the feeder pipe has reached the bottom of the hole, the control valve is returned to its inital position so that the motor stops.

When a lever of a control valve 30 for a cement material feed pump 32 is actuated, pressure oil flows to a hydraulic motor 31 which rotates the pump so that it starts to pump cement material into the feeder pipe 2. The pressure oil circuit of the motor 31 is connected via a flow control valve 33, a pressure reducing valve 37 and a shuttle valve 34 to the hydraulic motor 29 of the actuator 9. The valve 37 allows a fluid flow through the valve until the fluid pressure in the motor 29 increases to a valve at which the actuator does not yet alone move the feeder pipe outwards in the hole, whereby only so much fluid flows through the valve that the pressure remains at said valve. When cement material is pumped into the drill hole under a certain feeding pressure SP, the cement material fills possible cracks and crushed zones as well as the space between the bottom of the drill hole and the feeder pipe tip. Because cement material cannot flow through the gap between the feeder pipe and the rock because of said dimensioning of the feeder pipe, the cement material produces a certain filling pressure TP in the hole. This pressure causes a pushing force on the feeder pipe, whereby the feeder pipe moves outwards in the hole due to the cooperation of the pushing force and the traction force of the actuator. The amount of cement material to be fed can be adjusted in different ways according to whether the bolt shall be cemented along its whole length or only at its inner end. When the pressure limit of the valve 37 is suitably adjusted, the feeding pressure remains at such a valve that the feeder pipe moves outwards in the hole at precisely the same speed as cement material fills the hole. By means of the flow control valve 33 the highest return speed of the feeder pipe can be adjusted.

The amount of cement material to be fed can be adjusted, for example, by means of a pressure accumulator 35 and a one-way restriction valve 36, whereby a predetermined amount of pressure oil is fed per time unit to the pressure accumulator through the throttle of the restriction valve 36. When oil is flowing into the accumulator, the accumulator pressure increases correspondingly. When the pressure in the accumulator increases to a predetermined valve the control valve 30 returns to its initial position so that the feed pump 32 and the hydraulic motor 29 stop. By adjusting the flow amount of oil to be fed into the accumulator by means of the throttle of the restriction valve 36, the feeding time and thereby the amount of cement material fed into the hole can be determined in advance. Correspondingly the adjustment can of course be made by adjusting the pressure which causes the control valve 30 to return.

When the lever of the control valve 28 for the actuator is pushed backwards, the hydraulic motor 29 continues to rotate the rolls 19 so that they move the feeder pipe into a completely outdrawn starting position.

The returning of the control valves can also be arranged by means of a pressure impulse caused by the feeder pipe at a certain point. It is also possible to arrange the operation by means of an electric impulse when using a solenoid valve, e.g. by means of a volume flow counter.

The operation of the device can also be made fully automatical, whereby the operator only starts the feeding operation and the device carries out the feeding stage by stage returning finally to its initial position.

It is possible to obtain the control for proceeding from step to step e.g. from the longitudinal movement of the feeder pipe from the hydraulic pressure of its feeding motor as well as when measuring the amount of cement material fed into the hole.

In the control circuit shown in FIG. 11, the actuator 9 of the feeder pipe is provided with a spring-released pressure fluid cylinder 39. The piston of the cylinder displaces the drive rolls 19 of the actuator between a drive position and a release position. The cylinder 39 is connected through said pressure operated flow direction control valve 39 to the pressure circuit of the feed motor 31.

The control circuit operates in the following manner:

The feeder pipe is pushed into the hole by means of the motor 29 and cement material is fed through the feeder pipe in the manner described above. When the space between the bottom of the hole and the feeder pipe tip is filled with cement material, the filling pressure TP of the cement material causes the pressure to rise in the circuit of the feed motor 31, whereby pressure fluid flows through the valve 37 into the cylinder 39. Because of this, the piston of the cylinder pushes the drive rolls 19 of the actuator free from contact with the feeder pipe, so that the feeder pipe can move axially with respect to the actuator and thus move outwards in the hole because of the filling pressure TP acting on the feeder pipe. Due to the movement of the feeder pipe, the pressure of the cement material in the hole decreases, whereby the pressure in the circuit of the feed motor decreases correspondingly and the pressure in the cylinder decreases. In consequence, the drive rolls of the actuator again stop the feeder pipe in its position.

In the control circuit shown in FIG. 12, the valve 37 in the control circuit shown in FIG. 10 is replaced by a solenoid valve 40 which is connected to a pressure connector 41 which is connected by a line 42 to sense the feeding pressure of the cement material in the feeder pipe 2. When the hole is filled with cement material and the pressure in the feeder pipe because of this increases to a value higher than the normal feed pressure, the pressure connector sends an impulse to the valve 40 which opens the admission of pressure fluid to the motor 29 of the feeder pipe. The motor draws the feeder pipe outwards in the hole, whereby the feed pressure of the cement material in the feeder pipe again decreases and provides by means of the pressure connector 41 an impulse changing the position of the valve 40, so that the motor 29 stops. The feeder pipe moves in this way step by step outwards in the hole, until the hole is filled to the desired length and the feeder pipe is wholly removed from the hole by actuating the control valve 28.

The drawings and the description relating thereto are only intended to illustrate the idea of the invention. In their details, the method and the apparatus according to the invention may vary within the scope of the claims.

I claim:

1. Apparatus for feeding cement material into a drill hole for cement bolting of a rock, comprising a feeder pipe which can be pushed into a drill hole essentially over the whole length of the hole portion to be filled with cement material through the feeder pipe;

an actuator provided with means for pushing the feeder pipe into the hole and drawing the pipe outwardly in the hole, feeding means for feeding cement material through the feeder pipe into the hole;

said apparatus having a sensing element provided for sensing the feed pressure of the feeding means for cement material and starting said drawing means for drawing out the feeder pipe when the feed pressure exceeds a predetermined set value (SP);

said apparatus further comprising the means for drawing the feeder pipe outwardly and the means for feeding cement material are pressure medium operated having a pressure medium circuit of a driving motor provided for the means for drawing the feeder pipe outwardly connected to a pressure medium circuit of a driving motor provided for the means for feeding cement material by means of a pressure reducing valve acting as the sending means;

so that the valve allows pressure medium to flow into the circuit of the driving motor of said means for drawing the pipe outwardly when the pressure in the circuit of the driving motor of said feeding means exceeds said set value (SP) of the feed pressure of the cement material.

2. Appartaus according to claim 1, wherein a connecting element is provided which connects said drawing means in and out of engagement with the feeder pipe, and a sensing element which senses the feed pressure of the cement material and is arranged to displace the connecting element to a position in which the drawing means are out of engagement with the feeder pipe when the feed pressure of the cement material exceeds the predetermined set value (SP).

* * * * *